United States Patent [19]

Bancroft

[11] Patent Number: 4,956,952

[45] Date of Patent: Sep. 18, 1990

[54] UNIVERSAL DOOR PANEL SYSTEM

[76] Inventor: Joseph C. Bancroft, 812 Sweetwater Blvd., Longwood, Fla. 32779

[21] Appl. No.: 394,888

[22] Filed: Aug. 17, 1989

[51] Int. Cl.[5] ..... E06B 1/04

[52] U.S. Cl. ..... 52/207; 52/731; 49/425

[58] Field of Search ..... 52/207, 730, 731; 49/425

[56] References Cited

U.S. PATENT DOCUMENTS

| | | | |
|---|---|---|---|
| 2,847,726 | 8/1958 | Frick | 52/207 |
| 3,097,401 | 7/1963 | Riegelman | 52/207 X |
| 3,324,597 | 6/1867 | Rich | 52/207 X |
| 3,348,349 | 10/1967 | Petersen | 52/731 X |
| 3,855,732 | 12/1974 | Sheaf | 49/425 |
| 4,262,450 | 4/1981 | Anderson | 49/425 |
| 4,763,446 | 8/1988 | Kelly | 52/207 X |

FOREIGN PATENT DOCUMENTS

| | | | |
|---|---|---|---|
| 7703278 | 9/1978 | Netherlands | 49/425 |
| 1194327 | 6/1970 | United Kingdom | 49/425 |

*Primary Examiner*—David A. Scherbel
*Assistant Examiner*—Lan Mai
*Attorney, Agent, or Firm*—MacDonald J. Wiggins

[57] ABSTRACT

A patio door system uses a metal frame attached to a door jamb. A door panel to be installed in the frame includes a metal sill member and a metal jamb member. A pair of fixed door panel adapters is provided for insertion into the panel sill member when the panel is to be used as a fixed door panel. When the door panel is to be used as a sliding panel, a pair of wheel assemblies is installed in the panel sill member, thus permitting a single panel to be adapted as either a fixed panel or as a sliding panel.

12 Claims, 3 Drawing Sheets

UNIVERSAL DOOR PANEL SYSTEM

BACKGROUND OF THE INVENTION

1. Field of the Invention

The present invention relates to multiple panel patio-type glass sliding doors, and more particularly to a universal door panel system that permits a universal door panel to be used either as a fixed panel or as a sliding panel.

2. Description of the Prior Art

Metal framed sliding doors with glass-glazed panels are widely used for access to patios, decks, porches and the like in both residential and commercial construction. In a common construction, a door assembly is delivered with a fixed panel and a sliding panel. Another common type utilizes two sliding panels, while others utilize all fixed panels. In the prior art, a panel frame for a fixed panel uses a different extrusion for its sill member than that of a sliding panel. The manufacturer must maintain a stock of such different finished configurations, adding to inventory costs.

There is a need for a door design in which a panel may be utilized either as a fixed panel or a sliding panel. The selection of a panel as a fixed panel or a sliding panel may thus be made at the time an order is filled. Advantageously, the invention reduces the number of types of panel members to be fabricated and inventoried.

SUMMARY OF THE INVENTION

The present invention is a patio door system having a metal frame for attaching to the door jambs of a door opening in a building. Two or more factory glass-glazed panels are provided. The panels include an essentially hollow extruded metal panel frame for the glazing, the frame having an extruded sill member of essentially rectangular cross section. The bottom edge of the panel sill member is open. A typical frame for a two panel door into which the panel is to be installed includes an extruded frame sill member having two panel tracks, each having an essentially semicircular track surface.

A door panel that is to slide has a pair of wheel assemblies installed within its sill member. Each wheel assembly includes a rectangular body installed within the panel sill member and attached therein by self tapping screws. Each wheel assembly body includes a wheel and axle installed at one end thereof. The periphery of the wheel is concave to ride on the panel tracks of the frame sill member. The upper head member of the door panel is inserted into a first channel of the door frame, and the door panel lowered to cause the wheels to engage a first panel track.

When a fixed panel is to be assembled, a pair of fixed panel adapters is installed within the hollow panel sill member of a universal door panel. The fixed panel adapter, in accordance with the invention, comprises a short section of an extrusion formed to be inserted into the panel sill. An arcuate channel in the lower edge of the adapter is formed to fit over the frame sill panel track. An adapter is installed at each end of the panel sill and attached thereto by self tapping screws.

The fixed panel is installed by inserting the upper end into a second channel in the frame head of the metal door frame and the panel sill is lowered so as to engage the panel track by the arcuate channel of the adapter. The fixed panel is moved to place the fixed panel jamb flush against the door frame jamb. A pair of anchoring clips is then installed with self tapping screws to the panel jamb and door frame jamb. This, the clips secure the fixed panel jamb within the door frame.

As will now be recognized, a manufacturer need construct but one style of door panel. When assembling a patio type door, any combination of sliding and fixed panels may be produced by installing either a pair of wheel assemblies or a pair of fixed panel adapters in the sill member of each of the universal panels.

It is therefore a principal object of the invention to provide a universal panel for patio type doors that may be quickly and easily adapted as a sliding panel or as a fixed panel, thereby reducing the manufacturer's extrusion requirements and inventory.

It is another object of the invention to provide a panel sill extrusion for a universal door panel formed to receive either wheel assemblies or fixed panel adapters.

It is still another object of the invention to provide a fixed panel adapter having a channel to engage a sliding panel track of a metal door frame sill extrusion to permit a fixed panel to be installed over a sliding panel track.

These and other objects and advantages will become apparent from the following detailed description when read in conjunction with the drawings.

DETAILED DESCRIPTION OF THE PREFERRED EMBODIMENT

Figure 1:
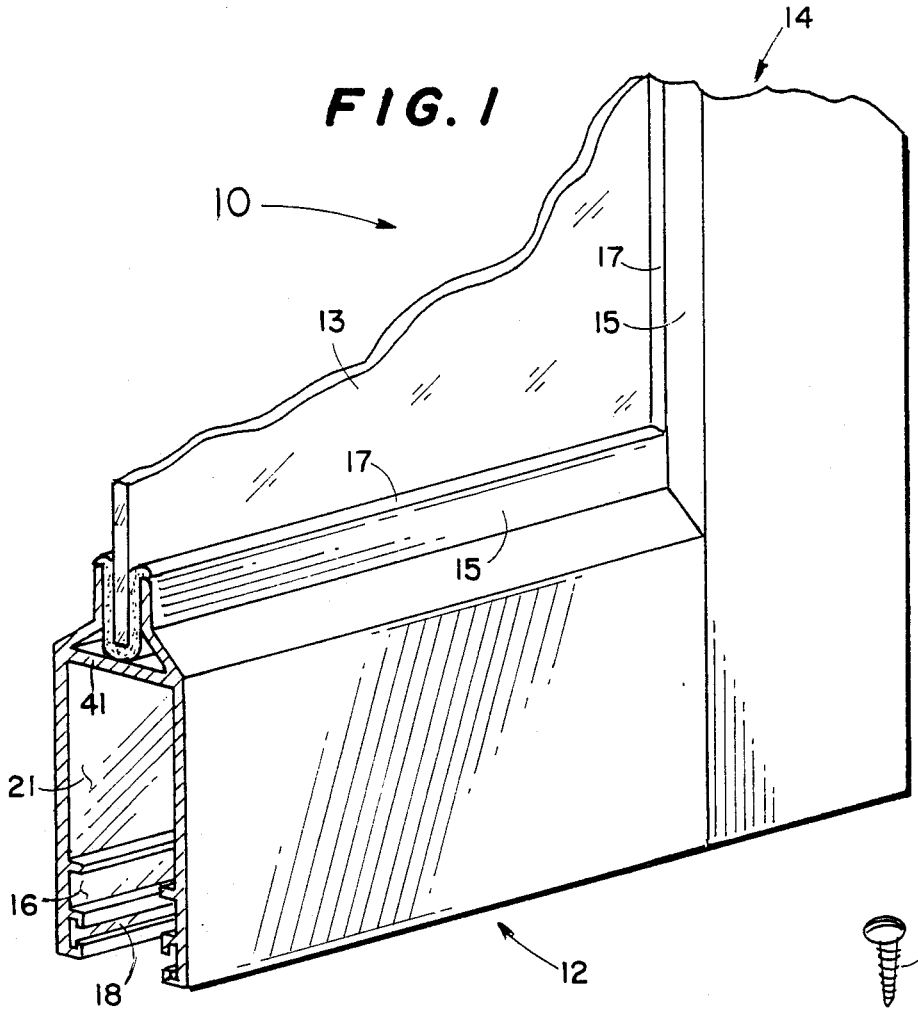
FIG. 1 s a perspective view of a lower corner portion of a universal patio door type panel showing the construction of the panel sill member.

Referring to FIG. 1 of the drawings, a lower corner of a universal door panel 10 is shown in cutaway view. The frame of panel 10 includes an extruded metal panel sill member 12 and a hollow extruded metal panel jamb member 14. Members 12 and 14 have recesses 15 to accept gaskets 17 and glazing 13. Sill member 12 includes an open interior space 21, a pair of interior grooves 16, and a pair of weatherstrip channels 18.

Figure 2:
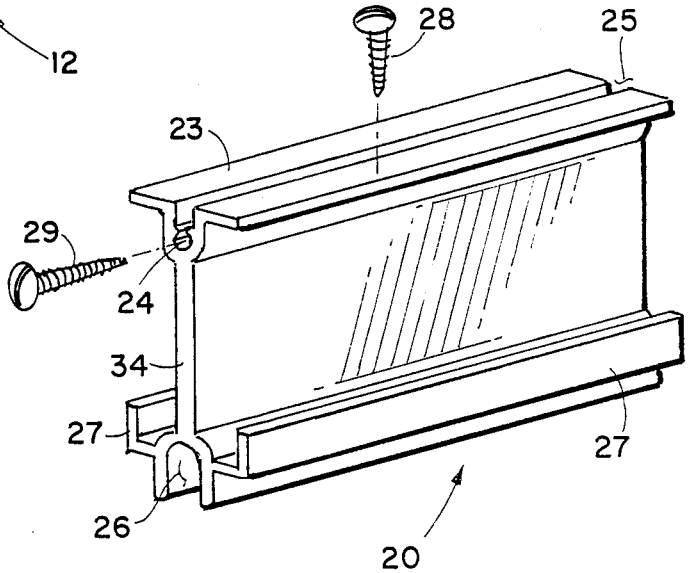
FIG. 2 is a perspective view of a fixed panel adapter for insertion into the panel sill member of FIG. 1 to permit use of the panel as a fixed panel.

FIG. 2 is a perspective view of a fixed panel adapter 20, extruded from aluminum or other suitable material. A web 34 is connected between upper lateral members 23 and lower lateral members 27. The width of members 23 and 27 is selected to fit within space 21 and channels 16 respectively. An arcuate channel 26 is formed along the lower edge of web 34 to fit a sill track as will be described hereinafter. A longitudinal slot 25 and a screw channel 24 is provided along the upper edge of web 34 to accept screws 29 and 28 when adapter 20 is used.

Figure 3:
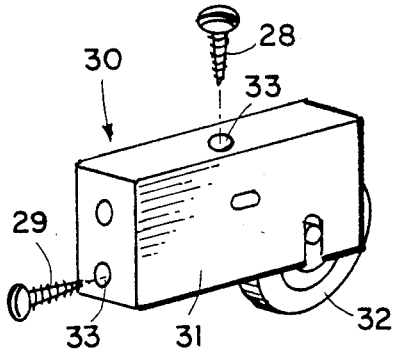
FIG. 3 is a perspective view of a wheel assembly for insertion into the panel sill member of FIG. 1 to permit use of the panel as sliding panel.

FIG. 3 is a perspective view of a wheel assembly 30 for installation in panel sill member 12. A rectangular body 31 has a wheel 32 mounted therein. Holes 33 are provided to accept mounting screws 28 and 29 as will be shown below.

Figure 4:
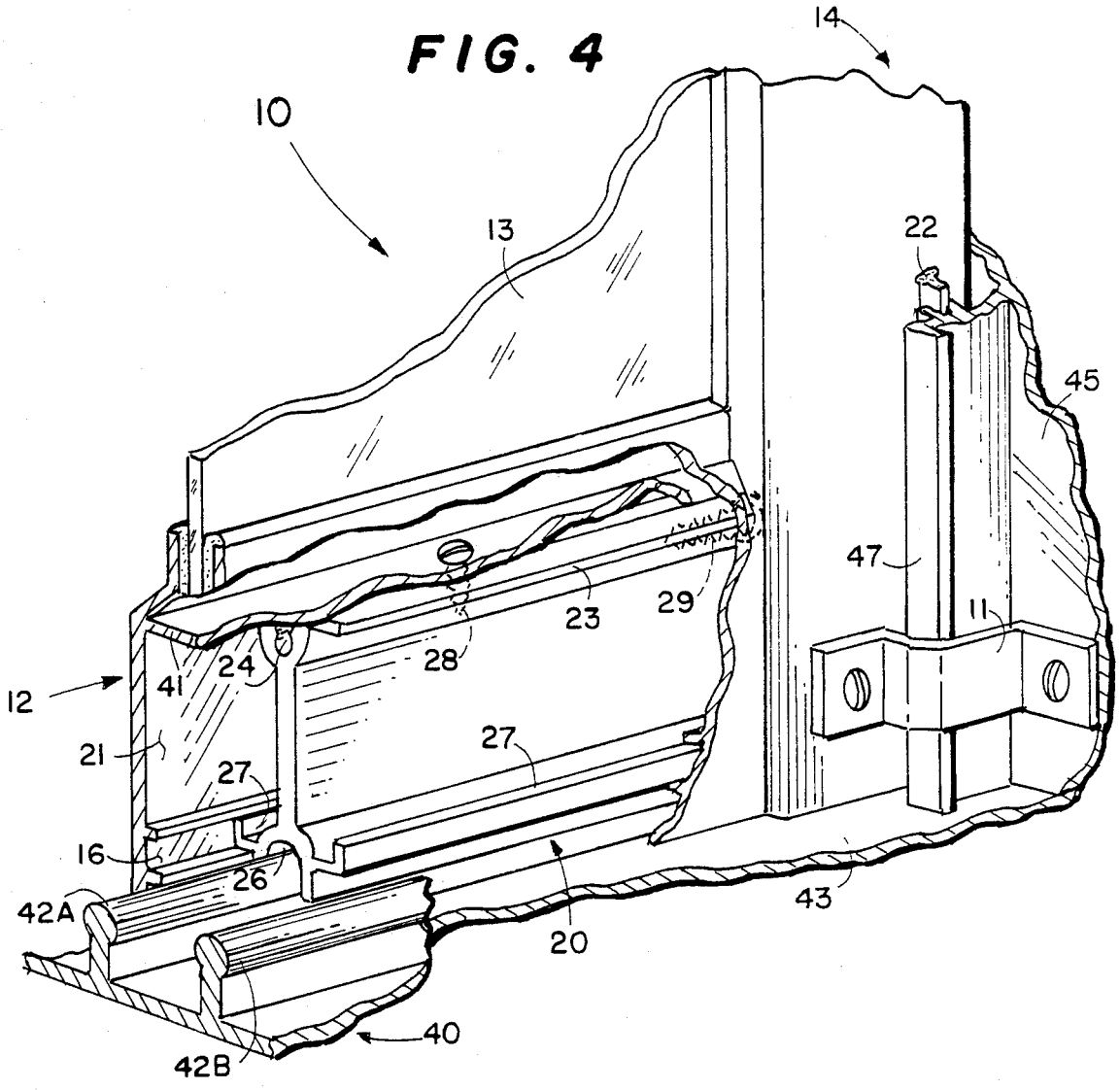
FIG. 4 is a cutaway perspective view of the panel of FIG. 1 having the fixed panel adapter of FIG. 2 installed, and the panel installed in a door frame.

Turning now to FIG. 4, a cutaway view of universal panel 10 having fixed panel adapter 20 installed therein is shown. As will be understood, an adapter 20 is installed at each lower corner of panel 10 and secured with screws 28 prior to assembly of panel jamb members 14 and glass 13. Preferably, upper portion 41 of panel sill member is predrilled for screws 28. After installation of panel jamb members 14, screws 29 are installed in predrilled holes. It will be noted that lateral members 27 of adapter 20 fit channels 16 and members 23 fit space 21.

A portion of the door frame 40 is shown. Frame sill member 43 is a metal extrusion having track elements 42A and 42B formed therein, with one track shown. A portion of frame jamb member 45 is also shown. An upper panel member (not shown), when panel 10 is installed in a door frame 40, fits within a channel in an upper door frame member (not shown), and channel 26 of fixed panel adapter 20 engages track element 42A. After installation of the panel 10 in door frame 40, panel 10 is moved such that panel jamb member 14 is in contact with frame jamb member 45. Two or more clips 11 are attached to frame jamb 45 and panel jamb member 14 by self-tapping screws 48. Clips 11 are installed on the door frame jamb 45 interior side such that panel 10 can only be removed from inside the building. Weatherstripping 22 in channel 47 portion of door frame jamb 45 engages panel jamb member 14. Although an exemplary cross-sectional shape of panel jamb member 14 is shown, other shapes are suitable.

Figure 5:
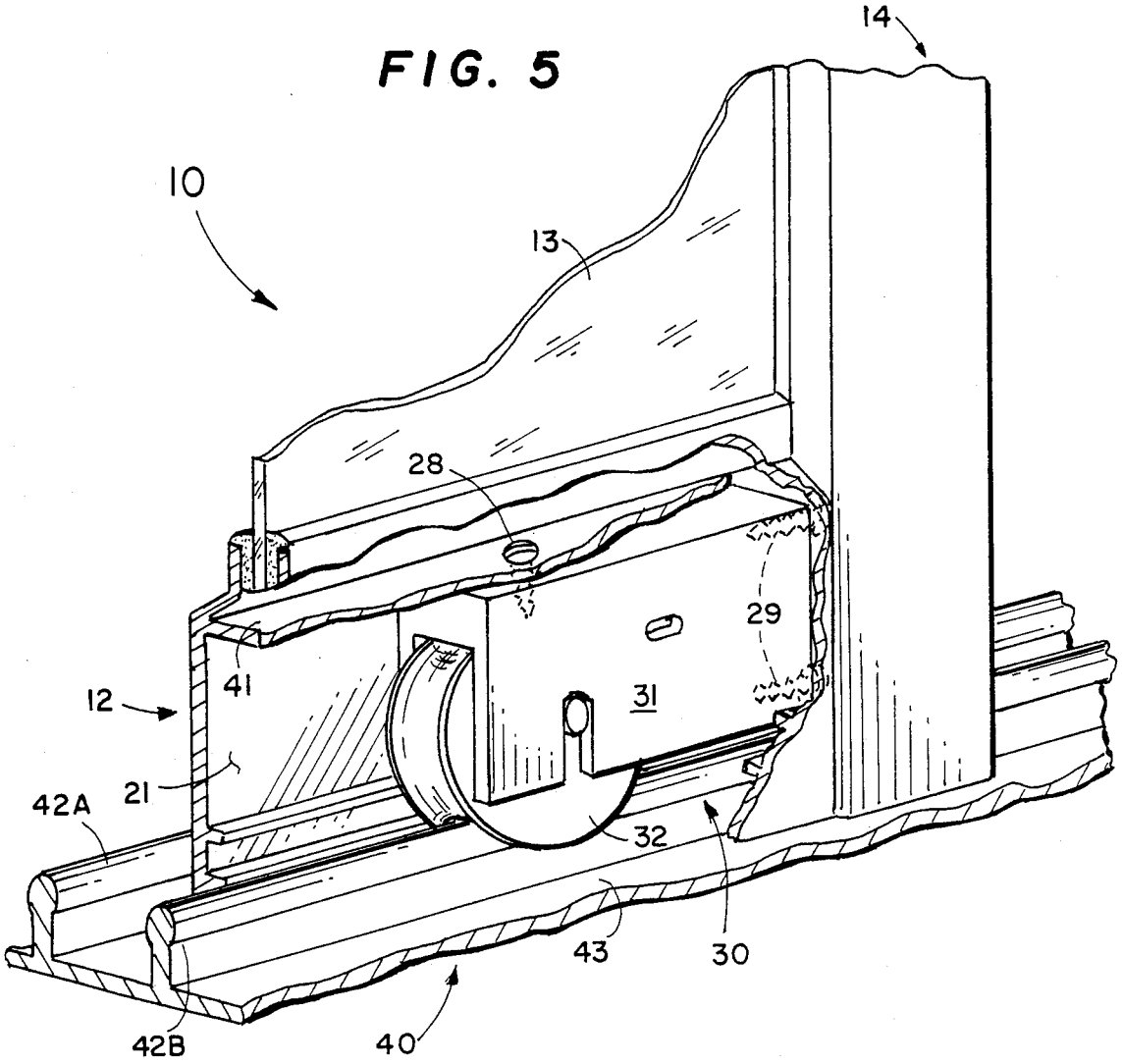
FIG. 5 is a cutaway perspective view of the panel of FIG. 1 having the wheel assembly of FIG. 3 installed, and the panel installed in a door frame.

When universal door panel 10 is to be used as a sliding panel, a pair of wheel assemblies 30 of FIG. 3 is installed in each end of panel sill member 12 prior to assembly of the panel frame as discussed above with reference to the fixed panel assembly. FIG. 5 illustrates the installation of one of the wheel assemblies 30 shown in cutaway view. Screw 28 is installed through a predrilled hole in upper portion 41 of sill member 12 into body 31 of wheel assembly 30. Screws 29 are installed after assembly of panel jamb members 14. Wheel 32 has a concave periphery which engages rail element 42B of frame sill member 40 when a sliding panel is installed in door frame 40. Thus, panel 10 is free to move as indicated by the arrow.

To fabricate a typical two-panel patio door in accordance with the invention, a first panel 10 has a pair of fixed panel adapters 20 installed on a first track within sill member 12 to form a fixed panel. The fixed panel is installed in a door frame 40 with channel 26 of adapter 20 engaging a first track 42A as seen in FIG. 4, and is attached to door frame jamb 45. A second panel 10 has a pair of wheel assemblies 30 installed within sill member 12 to form a sliding panel. The sliding panel is installed in the door frame with wheels 32 engaging a second track 42B, as shown in FIG. 5.

As will now be understood, a universal door panel and system for adapting the universal panel as a fixed panel or a sliding panel has been disclosed. Although the invention has been described with reference to a patio type door assembly, it is not to be limited thereto. The invention may be applied to windows, and to non-glazed doors and the like. Specific details have been shown for illustrative purposes only, and various modifications thereto may be made without departing from the spirit and scope of the invention.

I claim:

1. A universal door panel for installation in a door frame for a patio door or the like, said door frame including a sill member having a first track and a second track, comprising:

(a) a pair of fixed panel adapters, each having
  (i) a body portion, and
  (ii) an arcuate channel along a lower edge thereof;
(b) a pair of wheel assemblies, each having
  (i) a body portion, and
  (ii) a wheel operatively disposed in said body portion, said wheel having an arcuate periphery; and
(c) a door panel metal frame having a hollow sill member, wherein said pair of fixed panel adapters, or said pair of wheel assemblies selectively wholly fitting within said hollow sill member;
(d) whereby said panel frame may be configured to provide either a fixed door panel or a sliding door panel.

2. The universal door panel as defined in claim 1 in which said panel frame and said fixed panel adapters are formed from aluminum extrusions.

3. The universal door panel as defined in claim 2 in which said sill member extrusion has an open interior space formed to mate with said fixed panel adapter extrusion.

4. The universal door panel as defined in claim 1 which further comprises means for securing said fixed panel adapters within said sill member.

5. The universal door panel as defined in claim 1 which further comprises means for securing said wheel assemblies within said sill member.

6. The universal door panel as defined in claim 1 in which said arcuate channel of each of said fixed panel adapters engages said first track of said sill member of said door frame when said panel frame is configured as a fixed panel.

7. The universal door panel as defined in claim 1 in which said arcuate periphery of said wheel engages said second track of said sill member of said door frame when said panel frame is configured as a sliding panel.

8. A patio door construction comprising:

a metal door frame having a frame sill member including at least two identical tracks formed therealong;

a pair of fixed panel adapters, each having a body portion, and an arcuate channel along a lower edge thereof;

a pair of wheel assemblies, each having a body portion, and a wheel operatively disposed in said body portion, said wheel having an arcuate periphery; and a pair of universal door panels having a metal panel frame, each of said panel frames including a hollow panel sill member formed for selectively receiving said pair of fixed panel adapters, or said pair of wheel assemblies;

a first one of said panel frames having said pair of fixed panel adapters installed in said panel sill member thereof to provide a fixed door panel, said first panel frame installed in said door frame with said arcuate channels of said fixed panel adapters engaging a first of said tracks, said first panel frame secured to said door frame; and a second one of said panel frames having said pair of wheel assemblies installed in said panel sill member thereof to provide a sliding door panel, said second panel frame installed in said door frame with said arcuate peripheries of said wheels engaging a second of said tracks, said second panel frame thereby providing a sliding door panel.

9. The door construction as defined in claim 8 in which said panel frame and said fixed panel adapters are formed from aluminum extrusions.

10. The door construction as defined in claim 9 in which said sill member extrusion has an open interior space formed to mate with said fixed panel adapter extrusions.

11. The door construction as defined in claim 9 which further comprises means for securing said fixed panel adapters within said first panel sill member.

12. The door construction as defined in claim 9 which further comprises means for securing said wheel assemblies within said second panel sill member.

* * * * *